US009386826B2

(12) United States Patent
Lu

(10) Patent No.: US 9,386,826 B2
(45) Date of Patent: Jul. 12, 2016

(54) ZIPPER WITH SHINE AND IMPROVED BONDING FORCE BETWEEN TOOTH AND TAPE

(71) Applicant: Shen Zhen Hua Sheng Da Zipper Co., Ltd., Shenzhen (CN)

(72) Inventor: Hao Lu, Shenzhen (CN)

(73) Assignee: SHEN ZHEN HUA SHENG DA ZIPPER CO., LTD. (CN)

( * ) Notice: Subject to any disclaimer, the term of this patent is extended or adjusted under 35 U.S.C. 154(b) by 219 days.

(21) Appl. No.: 14/269,279

(22) Filed: May 5, 2014

(65) Prior Publication Data

US 2015/0313322 A1 Nov. 5, 2015

(51) Int. Cl.

| | |
|---|---|
| ***A44B 19/40*** | (2006.01) |
| ***A44B 19/08*** | (2006.01) |
| ***A44B 19/34*** | (2006.01) |
| ***A44B 19/06*** | (2006.01) |

(52) U.S. Cl.

CPC ..... *A44B 19/06* (2013.01); *A44B 19/08* (2013.01); *A44B 19/346* (2013.01); *A44B 19/403* (2013.01); *Y10T 24/2555* (2015.01); *Y10T 24/2557* (2015.01); *Y10T 24/2559* (2015.01)

(58) Field of Classification Search

CPC .... A44B 19/403; A44B 19/346; A44B 19/08; Y10T 24/2557

See application file for complete search history.

(56) References Cited

U.S. PATENT DOCUMENTS

| | | | | |
|---|---|---|---|---|
| 4,402,115 A * | 9/1983 | Moertel | ..... | A44B 19/34 24/410 |
| 5,678,285 A * | 10/1997 | Germani | ..... | A44B 19/08 24/403 |
| 7,337,506 B2 * | 3/2008 | Kusayama | ..... | A44B 19/08 24/389 |
| 7,870,649 B2 * | 1/2011 | Mikuma | ..... | A44B 19/04 24/403 |

* cited by examiner

*Primary Examiner* — Robert J Sandy

(74) *Attorney, Agent, or Firm* — Garcia-Zamor IP Law; Ruy M. Garcia-Zamor

(57) ABSTRACT

A zipper of the disclosure includes a pair of opposite tapes. A plurality of teeth are positioned at a bonding area of each tape. Each of the plurality of teeth 100 defines a positioning groove, and includes a post located in the positioning groove. A portion of the bonding area of the tape corresponding to each tooth defines at least one positioning hole. The post of each tooth passes through a corresponding positioning hole to fix the tooth on the tape firmly.

14 Claims, 15 Drawing Sheets

ZIPPER WITH SHINE AND IMPROVED BONDING FORCE BETWEEN TOOTH AND TAPE

BACKGROUND

1. Technical Field

The present disclosure generally relates to zippers, and especially to a zipper with a shine and an improved bonding force between a tooth and a tape of the zipper.

2. Description of Related Art

FIG. 15 is a cross sectional view of a traditional derlin zipper. The traditional derlin zipper generally includes a pair of tapes 6' and a plurality of teeth 100' positioned on the opposite edges of the tapes 6'. Each tooth 100' is positioned at two sides of the tape 6', and enwraps a thick filler cord 5' of the tape 6' to fix the tooth 100' with the tape 6'. However, because the tooth 100' is made of derlin material, and plus the tooth 100' is fixed with the tape 6' only by an enwrapping force between the tooth 100' and the filler cord 5' of the tape 6', bonding capacity between the tape 6' and the tooth 100' is week. As a result, the tooth 100' is prone to escape from the tape 6'.

Therefore, a need exists in the industry to overcome the described problems.

SUMMARY

The disclosure is to offer a zipper, a bonding capacity between a tooth and a tape of the zipper is obviously improved to prevent the tooth escaping from the tape.

A zipper of the disclosure includes a pair of opposite tapes. Each tape includes a bonding area, and a plurality of teeth are positioned on the bonding area along a length direction of the tape. Each tooth defines a positioning groove, the bonding area of each tape jams into the positioning grooves of the plurality of teeth to position the teeth on the tape. A portion of the bonding area of each tape corresponding to one tooth defines at least one positioning hole. Each tooth includes at least one post located in the positioning groove of the tooth, and the post passes through a corresponding positioning hole to fix the tooth on the tape.

Preferably, each tooth includes a lower body and an upper body located upon the lower body, and the positioning groove is located between the upper body and the lower body. The positioning groove includes a fixing groove and a inserting groove extending from the fixing groove and to an exterior surface of the tooth. Two ends of the post are respectively connected with the upper body and the lower body. Each tape includes a filler cord latched into the fixing groove, a group of warp yarns, and a group of continuously distributed weft yarns interwoven with the group of warp yarns. The bonding area of each tape inserts into the inserting grooves of the teeth, and the post of each tooth is located at the inserting groove of the tooth and passes through a corresponding positioning hole in the bonding area of the tape.

Preferably, the upper body includes a upper surface, a side surface and a first slant surface. The upper surface includes a top surface and a second slant surface obliquely extending from the top surface and downwards the lower body. The second slant surface gradually shrinks to be a point, and the first slant surface connects between the upper surface and the side surface.

Preferably, the upper body includes a head and a tail extending from the head.

The side surface includes a pair of first sub surfaces, a pair of second sub surfaces, and a third sub surface. One end of one of the first sub surfaces intersects one end of another one of the first sub surfaces to collectively forms the head of the upper body. The pair of second sub surfaces extend from other ends of the pair of the first sub surfaces, respectively, and the third sub surface connects between the pair of second sub surfaces. The pair of second sub surfaces and the third sub surface collectively forms the tail of the upper body.

Preferably, an included angle between the pair of first sub surfaces is larger than 30° and less than 45°.

Preferably, the first slant surface includes a pair of first sub slant surfaces, a pair of second sub slant surfaces, and a third sub slant surface. One of the first sub slant surfaces connects between the second slant surface, one of the first sub surfaces, one of the second sub slant surfaces, and the top surface. Another one of the first sub slant surfaces connects between the second slant surface, another one of the first sub surfaces, another one of the second sub slant surfaces, and the top surface. One of the second sub slant surfaces connects between one of the second sub surfaces and the top surface, and another one of the second slant surface connects between another one of the second sub surfaces and the top surface. The third sub slant surface connects between the third sub surface and the top surface.

Preferably, a length of the tail is less than 65% of a length of the upper body.

Preferably, the tooth further includes a projection partially surrounding one end of the tail away from the head, and a top of the projection is configured as a slant surface.

Preferably, a length of the positioning groove is greater than 50% of a length of the projection.

Preferably, the positioning holes in the bonding area of each tape are positioned continuously, and space from each other along an orientation of the teeth. The positioning holes are formed by structure configuration of the group of warp yarns, during a process of weaving the tape.

Preferably, the positioning holes in the bonding area evenly space from each other, and three weft yarns are positioned between each two neighboring positioning holes.

Preferably, an unoccupied position without any warp yarn is defined on the bonding area of the tape, and each positioning hole extends to the unoccupied position.

Preferably, the positioning holes in the bonding area evenly space from each other, and four weft yarns are positioned between each two neighboring positioning holes.

Preferably, the boding area of the tape defines two rows positioning holes arranging continuously and evenly spacing from each other.

Preferably, the warp yarns are made of polyester drawn yarn.

It follows that, a bonding structure between the tape and the tooth of the zipper of the disclosure is changed fundamentally. That is, except an enwrapping force between the tooth and the filler cord of the tape, there is a plus bonding force between the post of the tooth and the tape by the insertion of the post of the tooth into the positioning hole of the tape. As a result, the bonding force between the tooth and the tape is improved obviously, which prevents the tooth escaping from the tape effectively.

In addition, the tooth of the zipper of the disclosure includes a plurality surfaces with different angles. When the zipper is shined by a light source, the tooth appears a plurality of reflective surfaces with different angles. The reflections of the light from the plurality of teeth are intermixed with each other, which results of a shining appearance of the zipper. As a result, the zipper decorates articles employing the zipper, and gives a gorgeous visual experience to people and enhances user's experience.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

FIG. 5 is added.

DETAILED DESCRIPTION

Figure 1:
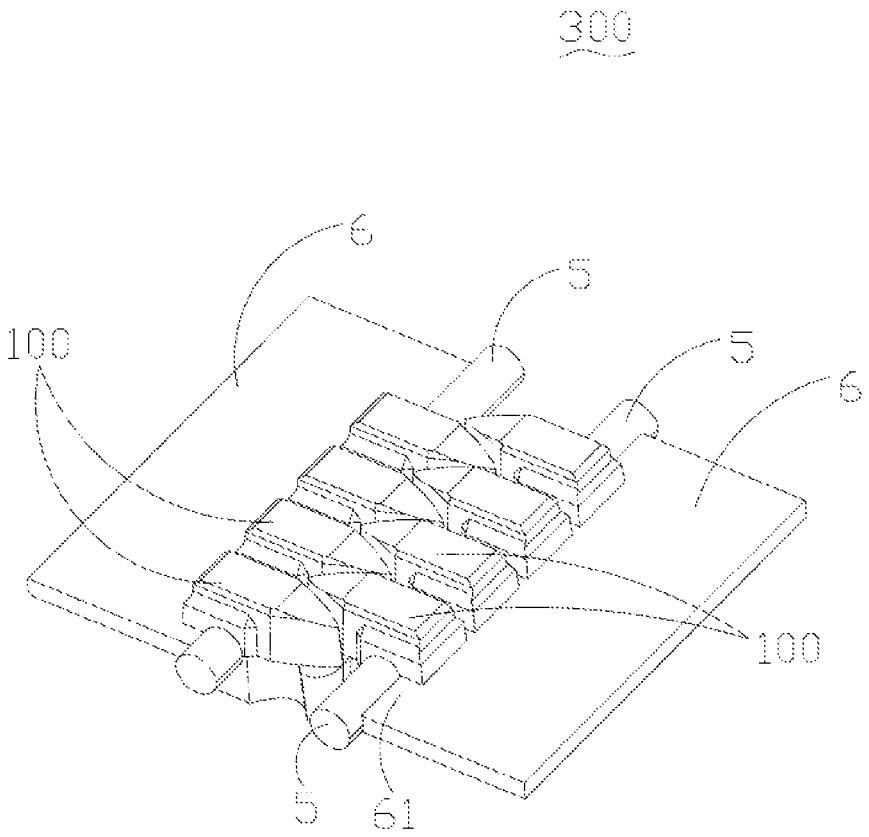
FIG. 1 is a perspective view of a zipper of the disclosure.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

Figure 2:
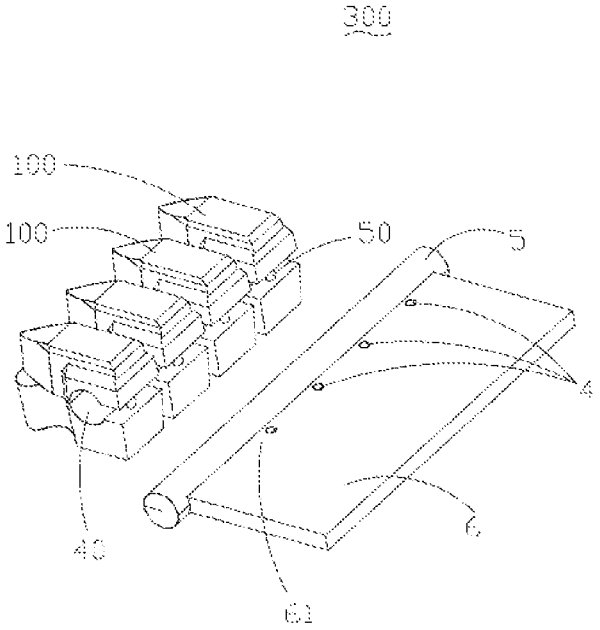
FIG. 2 is an exploded view of the zipper of FIG. 1.
Figure 3:
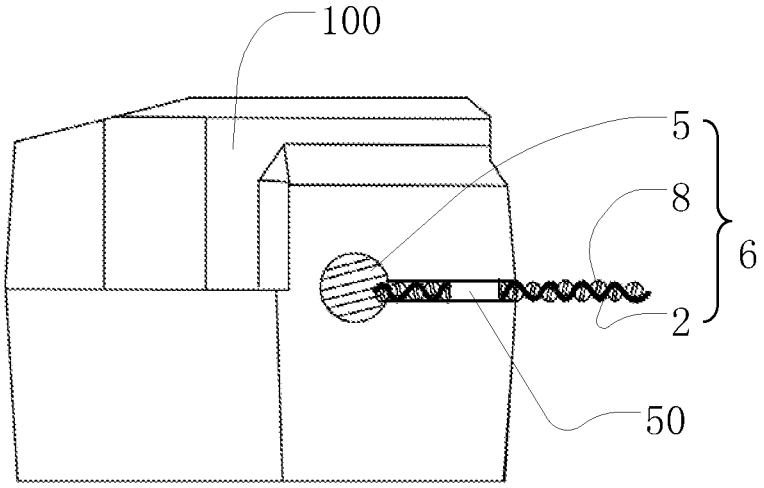
FIG. 3 is a diagram of a bonding structure of a tooth and a tape of the zipper of FIG. 1.

With reference to FIGS. 1-3, a zipper 300 of the disclosure includes a pair of opposite tapes 6. Each of the pair of tapes 6 includes a bonding area 61 along a length direction of the tape 6, and a plurality of teeth 100 are positioned at the bonding area 61. Each of the plurality of teeth 100 defines a positioning groove 40. In assembly, the bonding area 61 of the tape 6 is latched into the positioning grooves 40 of the teeth 100 to fix the teeth 100 with the tape 6.

A portion of the bonding area 61 of the tape 6 corresponding to each of the plurality of the teeth 100 defines at least one positioning hole 4. Correspondingly, each tooth 100 includes at least one post 50 located at the positioning groove 40. In assembly, the post 50 of each of the teeth 100 passes through the corresponding positioning hole 4, and two ends of the post 50 are fixed with the tooth 100, shown as FIG. 3.

In particular, the zipper 300 is a derlin zipper, and the zipper 300 is made by a process of injection molding. The post 50 of the tooth 100 of the zipper 300 is formed during the process of injection molding of the zipper 300. During the process of the injection molding of the zipper 300, the liquid derlin material flows into the positioning hole 4, and the post 50 is formed in the positioning groove 40 together with the tooth 100.

Figure 4:
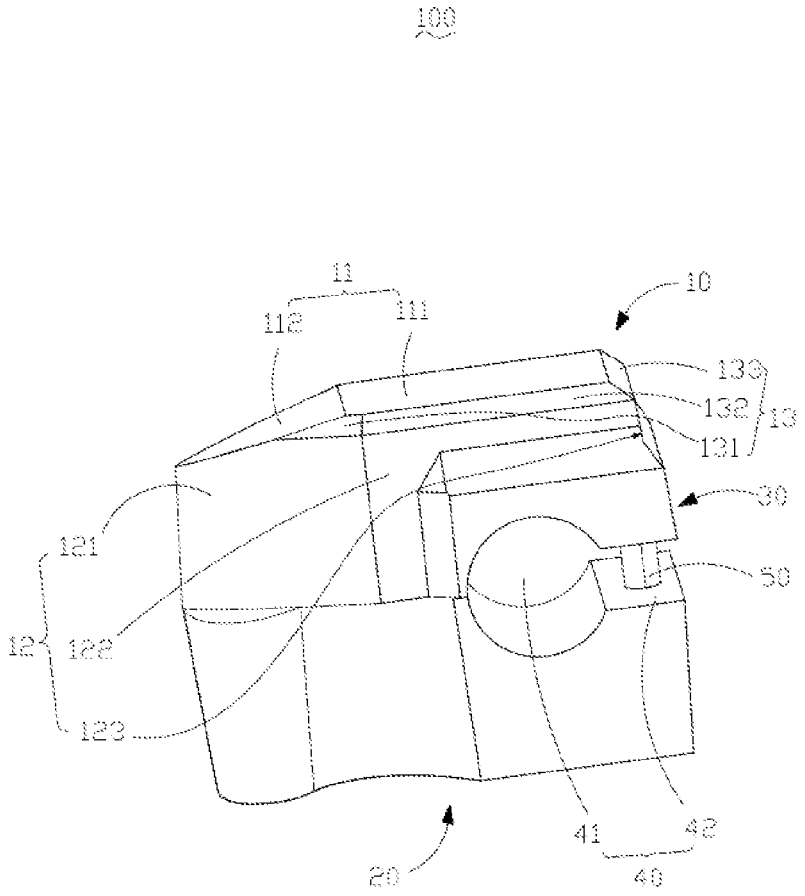
FIG. 4 is a perspective view of the tooth of the zipper of FIG. 1.

In detail, during the process of molding the zipper 300, the liquid derlin material flows into the positioning hole 4 in the portion of the bonding area 61 of the tape 6 corresponding to one of the plurality of the teeth 100, shown as FIG. 3. After a cooling action, the post 50 is formed in the positioning groove 40 together with the tooth 100, and penetrates the tape 6. As a result, because, the post 50 of the tooth 100 passes through the positioning hole 4 of the tape 6, the tooth 100 fixes with the tape 6 firmly With reference to FIG. 4, each tooth 100 includes a lower body 20 and an upper body 10 located upon the lower body 20. The positioning groove 40 is located between the upper body 10 and the lower body 20. The positioning groove 40 includes a fixing groove 41 and an inserting groove 42 extending from the fixing groove 41 to an exterior surface of the tooth 100. The two ends f the post 50 are connected with the upper body 10 and the lower body 20, respectively.

With reference to FIG. 2 and FIGS. 11-14, each tape 6 includes a filler cord 5, a group of warp yarns 8, and a group of continuous distributed weft yarns 2 interwoven with the group of warp yarns 8. In assembly, the filler cord 5 is latched into the fixing groove 41, and the bonding area 61 of the tape 6 is inserted into the inserting groove 42. In the embodiment, the post 50 of each tooth 100 is located at the inserting groove 42 and passes through the corresponding positioning hole 4 of the tape 6.

Apparently, the bonding structure between the tape 6 and the tooth 100 of the zipper 300 of the disclosure is changed fundamentally. That is, except an enwrapping force between the tooth 100 and the filler cord 5 of the tape 6, there is a plus bonding force between the post 50 and the tape 6 by the insertion of the post 50 of the tooth 100 into the positioning hole 4 of the tape 6. Similar as a role of the reinforcing bar in the concrete, the bonding force between the post 50 and the tape 6 is much greater than the enwrapping force between the tooth 100 and the filler cord 5 of the tape 6. In addition, each tooth 100 includes at least one post 50. As a result, the bonding force between the tooth 100 and the tape 6 is improved greatly, which prevents the tooth 100 escaping from the tape 6 effectively.

The structures of the tooth 100 and the tape 6 will be illustrated in detail as following one by one.

With reference to FIGS. 4-9, the upper body 10 includes an upper surface 11, a side surface 12 and a first slant surface 13. The upper surface 11 includes a top surface 111, and a second slant surface 112 obliquely extending from the top surface 111 and downwards the lower body 20. The second slant surface 112 gradually shrinks to be a point. The first slant surface 13 connects between the upper surface 11 and the side surface 12.

When the tooth 100 is combined with the tape 6 to form the zipper 300, the teeth 100 on the two opposite tapes 6 engage with each other, and the upper bodies 10 of the tooth 100 are exposed upon the tapes 6, shown as FIG. 1. When the zipper 300 is shined under a light source, the second slant surface 112 and the first slant surface 13 form reflective surfaces with different angles. The reflections of the light from the plurality of teeth 100 are intermixed with each other, which results of a shining appearance of the zipper 300. As a result, the zipper 300 decorates articles employing the zipper 300, and gives a gorgeous visual experience to people and enhances user experience.

In detail, the side surface 12 includes a pair of first sub surfaces 121, a pair of second sub surfaces 122, and a third sub surface 123. One end of one of the first sub surfaces 121 intersects one end of another one of the first sub surfaces 121. The pair of second sub surfaces 122 extend from another ends of the pair of first sub surfaces 121, respectively. The third sub surface 123 connects between the pair of second sub surfaces 122.

The first slant surface 13 includes a pair of first sub slant surfaces 131, a pair of second sub slant surfaces 132, and a third sub slant surface 133. One of the first sub slant surfaces 131 connects between the second slant surface 112, one of the first sub surface 121, one of the second sub slant surfaces 132 and the top surface 111. Another one of first sub slant surfaces 131 connects between the second slant surface 112, another one of the first sub surfaces 121, another one of the second sub slant surfaces 132 and the top surface 111. One of the second sub slant surface 132 connects between one of the second sub surfaces 122 and the top surface 111, another one of the second sub slant surfaces 132 connects between another one of the second sub surfaces 122 and the top surface 111. The third sub slant surface 133 connects between the third sub surface 123 and the top surface 111.

Figure 6:
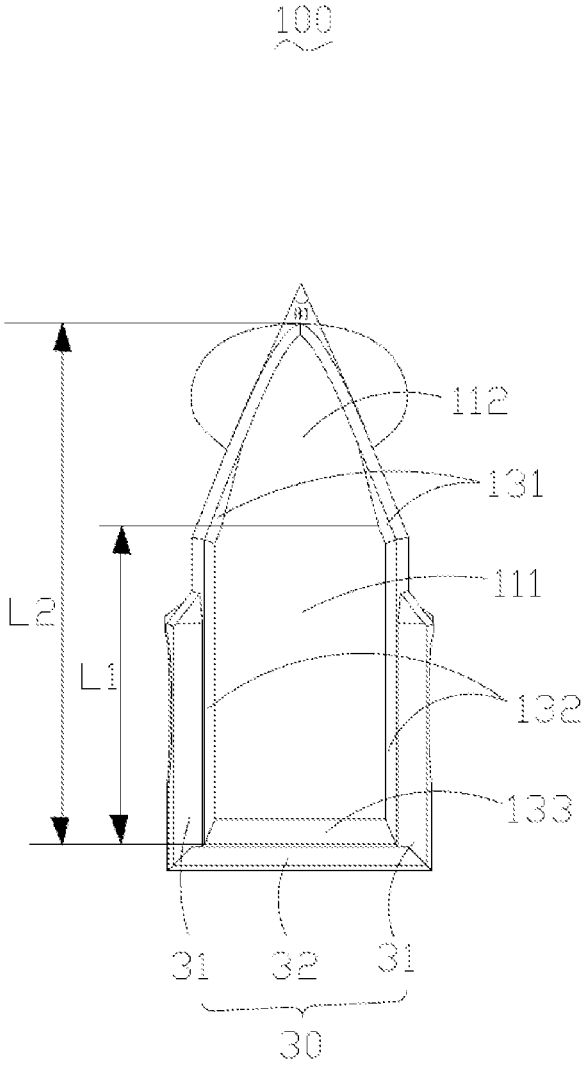
FIG. 6 is a front view of the tooth of FIG. 4.

In the embodiment, an included angle θ1 between the pair of first sub surfaces 121 is larger than 30° and less than 45°, that is, 30°<θ1<45°, shown as FIG. 6. The included angle θ1 is positioned so as to prevent interference between the engaged teeth 100, during a process of engagement of the teeth 100 positioned on the opposite tapes 6.

In other words, the pair of first sub surfaces 121 of the tooth 100 of the disclosure intersect with each other to collectively form a head 15 of the tooth 100, and the pair of second sub surfaces 122 extend from the pair of first sub surfaces 121, respectively, to collectively form a tail 16 of the tooth 100. That is, the tail 16 extends from the head 15, and the head 15 gradually shrinks away the tail 16, shown as FIG. 5. In a fabricating process of the tooth 100, the first slant surface 13 is formed by cutting an edge of the upper surface 11 of the upper body 10 downwards the lower body 20. The second slant surface 112 and the pair of first sub slant surfaces 131 are formed by cutting the upper surface 11 of the head 15 downwards the lower body 20. In the embodiment, an angle θ4 between the second slant surface 112 and the top surface 111 is configured as 10°, which enhances reflection effect of tooth 100. The head 15 and the tail 16 are positioned so as to cause the tooth 100 of the disclosure to appear a slim and lightweight appearance.

In the embodiment, a length L1 of the tail 16 is less than 65% of a total length L2 of the upper body 10, shown as FIG. 6, which prevents interference between the heads 15 of the engaged teeth 100, during a process of engagement of the teeth 100 positioned on the opposite tapes 6, so as to ensure smooth engagement between the engaged teeth 100 of the zipper 300.

Figure 5:
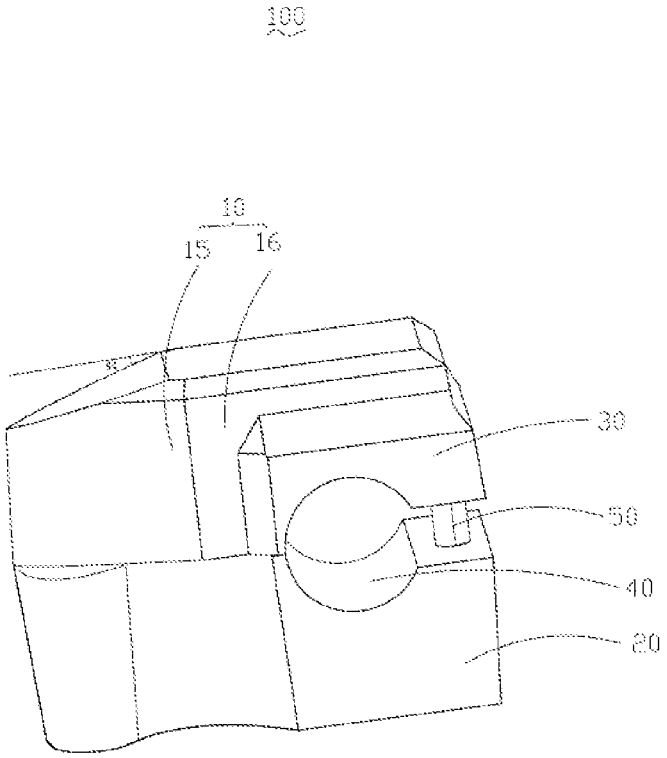
FIG. 5 is similar as FIG. 4, in order to designate number conveniently and clearly.

In the embodiment, the tooth 100 further includes a projection 30 partially surrounding one end of the tail 16 far away from the head 15, shown as FIG. 5. A top of the projection 30 is configured as a slant surface. The slant surface on the top of the projection 30 is positioned so as to make the tooth 100 to plus add a plurality of reflective surfaces with different angle, which not only enhances light reflection effect of the tooth 100, but also causes the tooth 100 to appear a slim, and lightweight appearance.

With reference to FIG. 5 and FIG. 6, in detail, the projection 30 includes a pair of first blocks 31, and a second block 32 connecting between the pair of first block 31. One of the first blocks 31 projects from one end of one of the second sub surfaces 122 adjacent to the third sub surface 123, another one of the first blocks 31 projects from one end of another one of the second sub surfaces 122 adjacent to the third sub surface 123. The second block 32 projects from the third sub surface 123.

Figure 7:
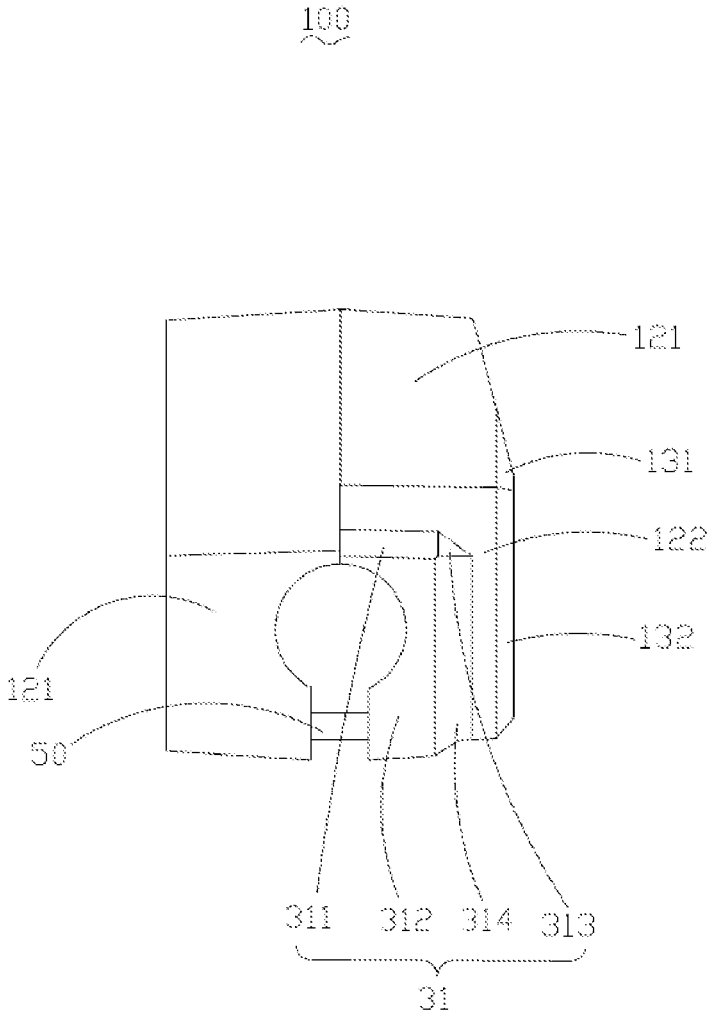
FIG. 7 is a left view of the tooth of FIG. 4.

In the embodiment, each first block 31 includes a fourth sub surface 311, a fifth sub surface 312, a fourth sub slant surface 313, and a fifth sub slant surface 314, shown as FIG. 7. The fifth sub surface 312 is parallel to a corresponding second sub surface 122, and the fourth sub slant surface 313 connects between the corresponding second sub surface 122, the fourth sub surface 311 and the fifth sub slant surface 314. The fifth sub slant surface 314 connects the corresponding fifth sub surface 312 and the corresponding second sub surface 122.

In other words, the fourth sub surface 311 is configured as a slant surface, and the fourth sub slant surface 313 is in a shape of a triangle. The three edges of the triangle connect with the second sub surface 122, the fourth sub surface 311 and the fifth sub slant surface 314, respectively.

Figure 9:
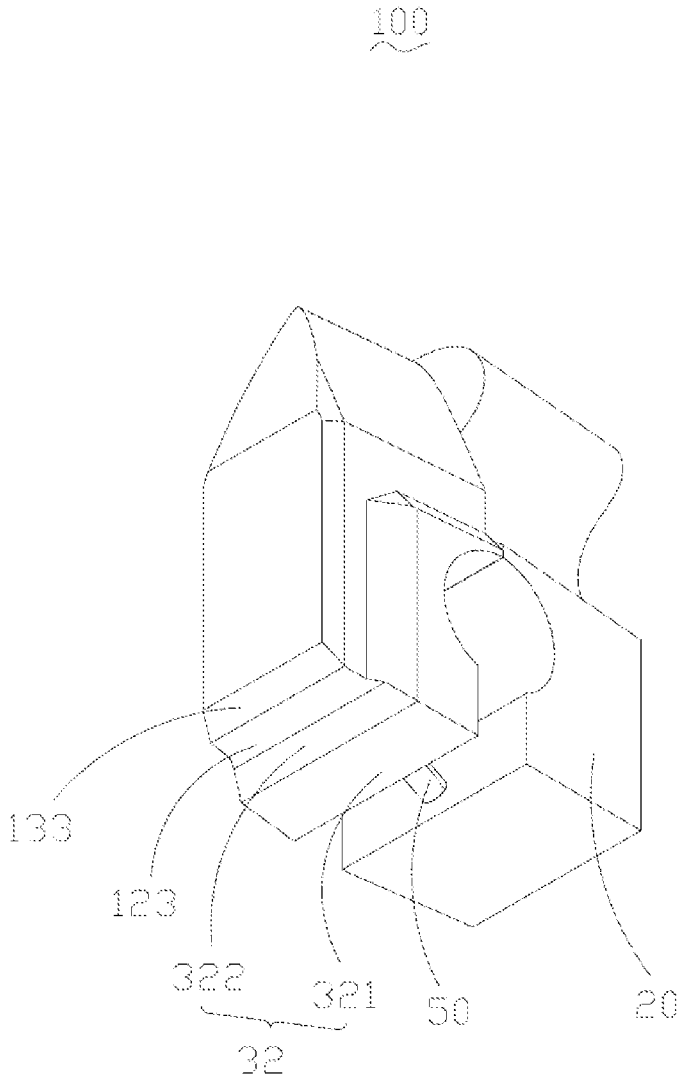
FIG. 9 is a back view of the tooth of FIG. 4.

With reference to FIG. 9, the second block 32 includes a sixth sub surface 321, and a sixth sub slant surface 322. The sixth sub surface 321 connects between the sixth sub surface 321 and the third sub surface 123.

Figure 8:
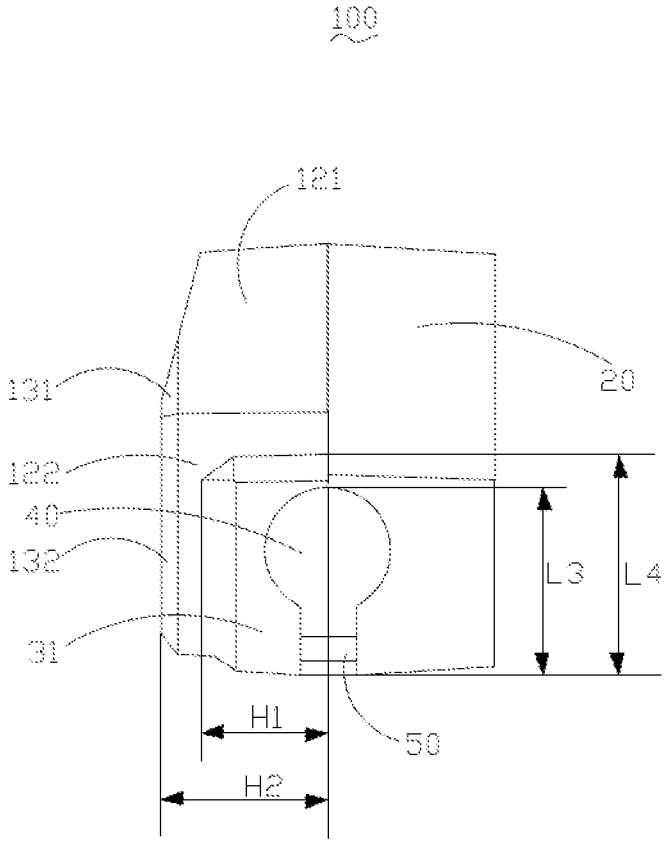
FIG. 8 is a right view of the tooth of FIG. 4.

In the embodiment, a height H1 of the projection 30 is greater than 50% of a height H2 of the upper body 10, shown as FIG. 8, which ensures the projection 30 to enwrap the filler cord 5 of the tape 6 with a larger area, and the projection 30 exposed upon the tape 6 to enhance the reflection effect of the tooth 100.

In the embodiment, a length L3 of the positioning groove 40 is greater than 50% of a length L4 of the projection 30, shown as FIG. 8, which enhances the bonding force between the projection 30 and the tape 6.

Figure 10:
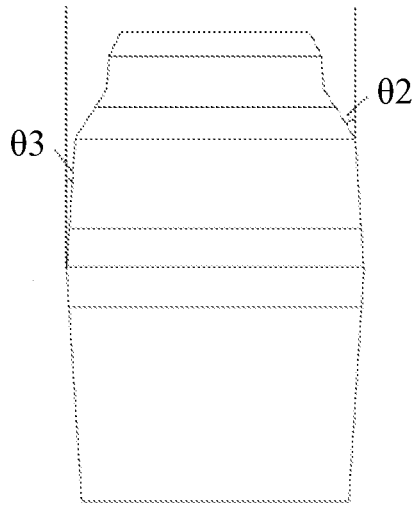
FIG. 10 is a diagram of a draft angle of the tooth of FIG. 4.

With reference to FIG. 10, in the embodiment, a draft angle θ2 of the upper body 10 is greater than or equal to 4°. A draft angle θ3 of the projection 30 is greater than or equal to 4°. The draft angles θ2, θ3 are configured so as to cause a mold uploading surface of the tooth 100 forms a light reflective surface to enhance the reflection effect of the tooth 100, except for benefit of mold uploading.

The structure of the tape 6 of the zipper 300 of the disclosure is illustrated detailedly as following.

In particular, the positioning holes 4 on the portion of the bonding area 61 of the tape 6 corresponding to each tooth 100 are formed by structure configuration of the warp yarns 8, during a process of weaving the tape 6.

Figure 11:
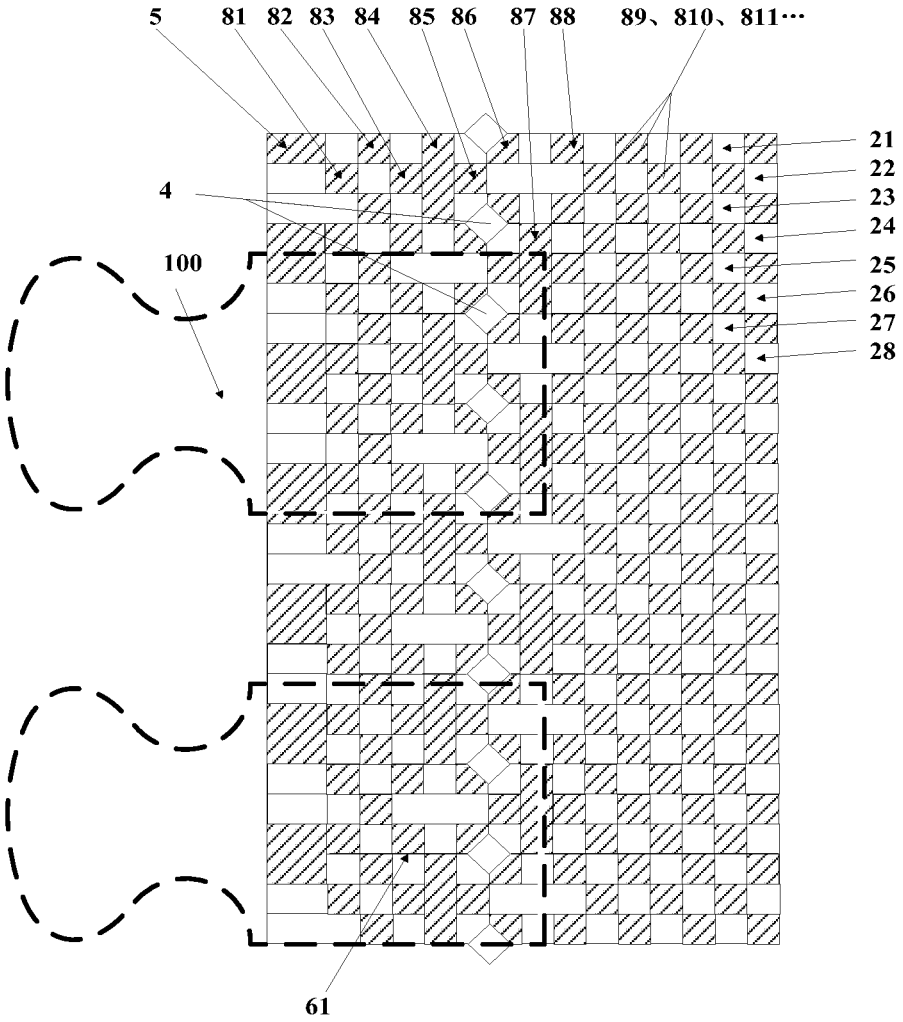
FIG. 11 is a partial diagram of a tape of FIG. 2 according to a first exemplary embodiment of the disclosure.

FIG. 11 is a partially diagram of the tape 6 of the zipper 300 according to a first exemplary embodiment of the disclosure. In the embodiment, the positioning holes 4 on the bonding area 61 of the tape 6 arrange continuously, and evenly space from each other. Three weft yarns 2 are positioned between each two neighboring positioning holes 4.

With reference to FIG. 11, some warp yarns 81, 82 . . . 86, 87 are positioned on the bonding area 61 of the tape 6, the left warp yarns 88, 89 . . . are positioned beyond the boding area 61 of the tape 6. The weft yarns 2 are organized on one panel in order. The warp yarns 83, 85 wriggle up one of the yarns 2 and down a next one of the weft yarns 2 in order. That is, the warp yarns 83, 85 are organized as a circulation structure with wriggle of the warp yarns 83, 85 up one of the weft yarns 2 and down a next one of the weft yarns 2. The warp yarn 84 between the warp yarn 83 and the warp yarn 85 wriggles down three of the weft yarns 2 and up next three of the weft yarns 2 in order. Meanwhile, the warp yarns 86, 88 are organized as an inverse order of the warp yarns 83, 85, and the warp yarn 87 is organized as an inverse order of the warp yarn 84. That is, the warp yarns 86, 88 wriggle down the one of the weft yarns 2 and up the next one of the weft yarns 2 in order. The warp yarn 87 wriggles up the three weft yarns 2 and down the next three weft yarns 2.

Because of the effect of the tension of the warp yarns 8, binding places between the weft yarns 21, 23 and the warp yarns 83, 85, 86, 88 move close to the weft yarn 22. Similarly, binding places between the weft yarns 24, 26 and the warp yarns 83, 85, 86, 88 move close to the weft yarn 25. Simultaneously, because of the effect of the tension of the weft yarns 2, binding places between the warp yarns 83, 85 and the weft yarns 21, 23, 24, 26 move close to the warp yarn 84. Similarly, binding places between the warp yarns 86, 88 and the weft yarns 21, 23, 24, 26 move close to the warp yarn 87. As a result, the positioning holes 4 is formed between the warp yarns 85, 86, and is formed between the weft yarns 23, 24. With the process of weaving of the tape 6, one row positioning holes 4 are formed continuously between the warp yarns 85, 86 on the bonging area 61 of the tape 6. In addition, the row positioning holes 4 evenly space from each other with three weft yarns 2, and are uniform in size.

Figure 12:
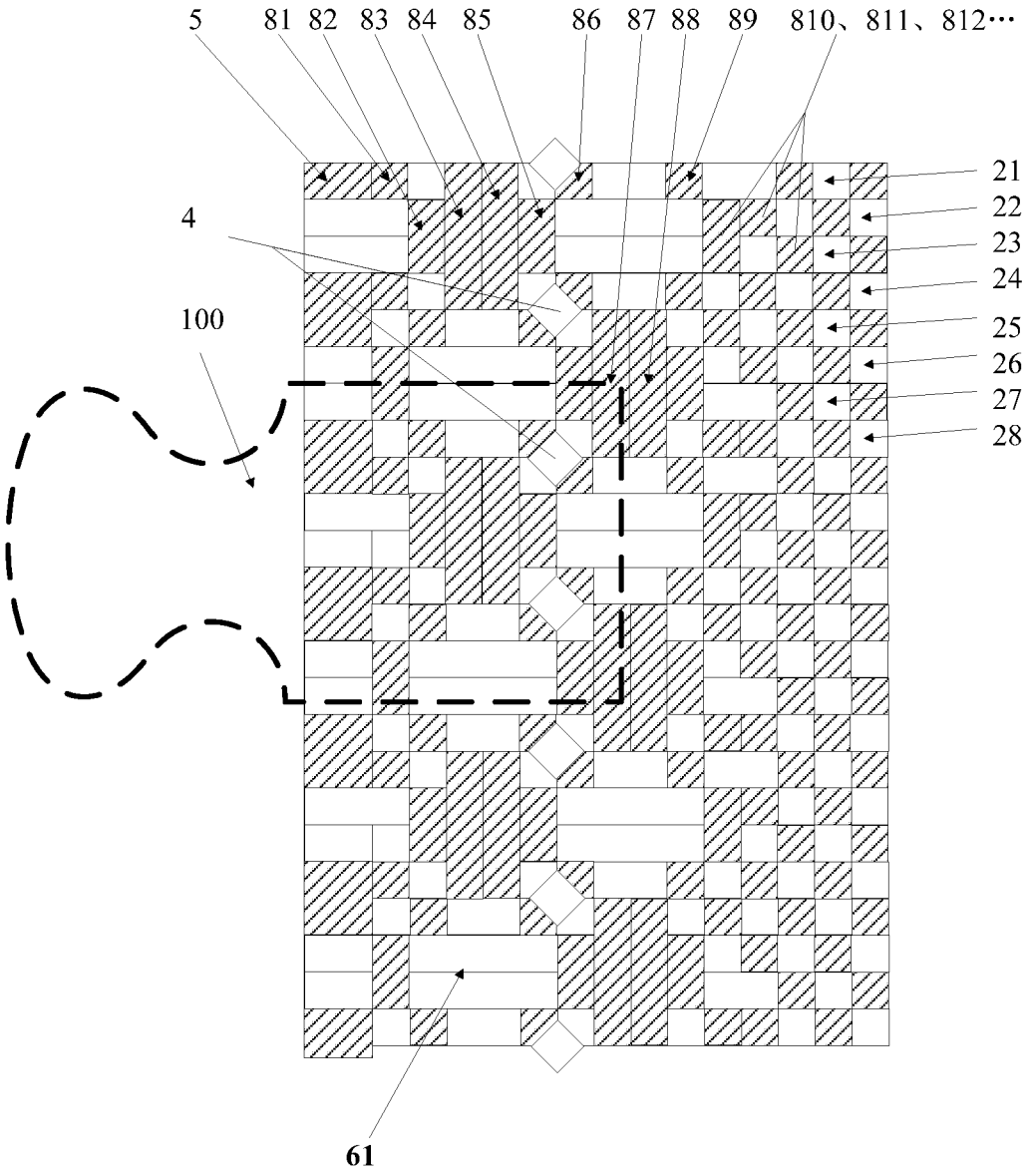
FIG. 12 is a partial diagram of the tape of FIG. 2 according to a second exemplary embodiment of the disclosure.

FIG. 12 is a partially diagram of the tape 6 of the zipper 300 according to a second exemplary embodiment of the disclosure. In the embodiment, the positioning holes 4 on the bonding area 61 of the tape 6 are arranged continuously, and evenly space from each other with four weft yarns 2. In detail, the warp yarns 82, 85 are organized as a circulation structure with wriggle of the warp yarns 82, 85 up one of the weft yarns 2, down next two of the weft yarns 2, up a next one of the weft yarns 2, down a next one of the weft yarns 2, up next two of the weft yarns 2 and down a next one of the weft yarns 2. The warp yarns 83, 84 between the warp yarn 82 and the warp yarn 85 are organized as a circulation structure with wriggle of the warp yarns 83, 84 down four of the weft yarns 2 and up next four weft yarns 2. In contrast, the warp yarns 86, 89 are organized as an inverse order of the warp yarns 82, 85, and the warp yarn 87, 88 are organized as an inverse order of the warp yarn 83, 84.

Similarly with the weaving principle of tape 6 of the first exemplary embodiment, because of the effect of the tension of the warp yarns 8 and the weft yarns 2, binding places between the warp yarns 85, 86 and the weft yarns 24, 25 move, and the positioning hole 4 is formed between the warp yarns 85, 86, and is formed between the weft yarns 24, 25. With the process of weaving of the tape 6, the positioning holes 4 are formed continuously between the warp yarns 85, 86 on the bonging area 61 of the tape 6. In addition, the positioning holes 4 evenly space from each other with four weft yarns 2, and are uniform in size.

Because the circulation structure of the tape 6 of the second exemplary embodiment is configured by four warp yarns 8 and four weft yarns 2, the binding places between the warp yarns 8 and the weft yarns 2 moves a greater distance than that of the first exemplary embodiment. As a result, a size of each of the positioning holes 4 of the second exemplary embodiment is greater than that of each of the positioning holes 4 of the first exemplary embodiment. Accordingly, a diameter of the post 50 is getting thick, which ensures the tooth 100 to fix with the tape 6 firmly.

Figure 13:
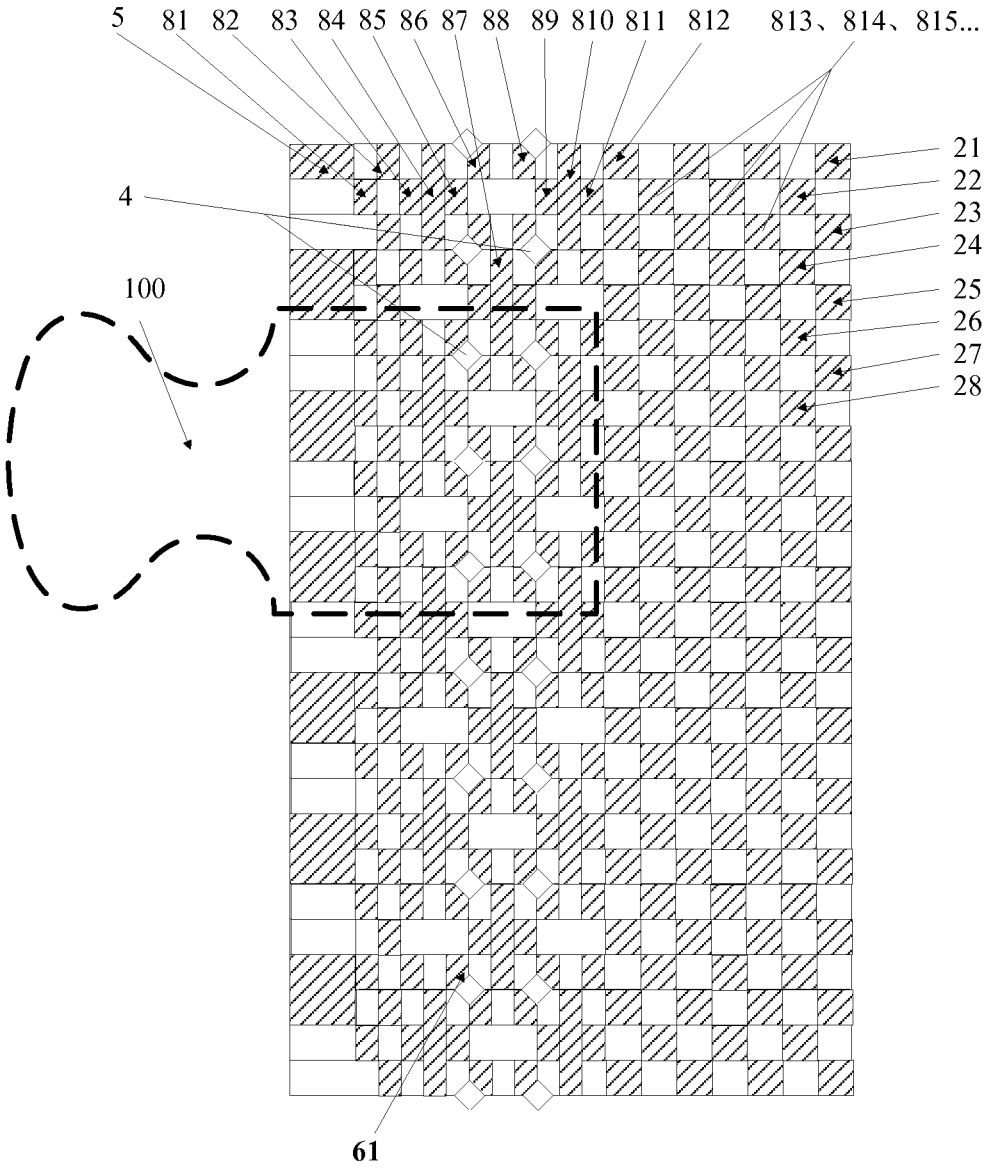
FIG. 13 is a partial diagram of the tape of FIG. 2 according to a third exemplary embodiment of the disclosure.

FIG. 13 is a partially diagram of the tape 6 of the zipper 300 according to a third exemplary embodiment of the disclosure. In the embodiment, two rows positioning holes 4 are arranged on the bonding area 61 of the tape 6 continuously, and evenly space from each other. In comparison with the tapes 6 of the first and second exemplary embodiment, the warp yarns 8 on the bonding area 61 of the tape 6 get thinner than that of the warp yarns 8 of the first and second exemplary embodiment. For example, a specification of each of the warp yarns 8 beyond the bonding area 61 of the tape 6 remains no change as 333dtex, and a specification of each of the warp yarns 8 on the bonding area 61 is reduced to be 167dtex. As a result, the number of the warp yarns 8 on the bonding area 61 increases correspondingly. For example, the warp yarns 81, 82 . . . 810, 811 are positioned on the bonding area 61 of the tape 6. The configuration of the warp yarns 83, 84, 85, 86, 87, 88, 89, 810, 811 are same as that of the warp yarns 83, 84, 85, 86, 87, 88 of the first exemplary embodiment. That is, in the third embodiment, the warp yarns 83, 85 are organized as a circulation structure with wriggle of the warp yarns 83, 85 up one of the weft yarns 2 and down a next one of the weft yarns 2 in order. The warp yarn 84 between the warp yarn 83 and the warp yarn 85 wriggles down three of the weft yarns 2 and up next three of the weft yarns 2 in order. Meanwhile, the warp yarns 86, 88 are organized as an inverse order of the warp yarns 83, 85, and the warp yarn 87 is organized as an inverse order of the warp yarn 84. The warp yarns 89, 811 are organized as a circulation structure with wriggle of the warp yarns 89, 811 up one of the weft yarns 2 and down a next one of the weft yarns 2 in order. The warp yarn 810 between the warp yarn 89 and the warp yarn 811 wriggles down three of the weft yarns 2 and up next three of the weft yarns 2 in order.

As a result, one row positioning holes 4 are formed between the warp yarns 85, 86, and another row positioning holes 4 are formed between the warp yarns 88, 89. Each row positioning holes 4 evenly space from each other with three weft yarns 2, and are uniform in size. Correspondingly, during the process of injection molding the tooth 100, two posts 50 are formed in the positioning groove 40 of the tooth, and pass through corresponding two positioning holes 4, respectively, which the tooth 100 to fix with the tape 6 firmly.

Figure 14:
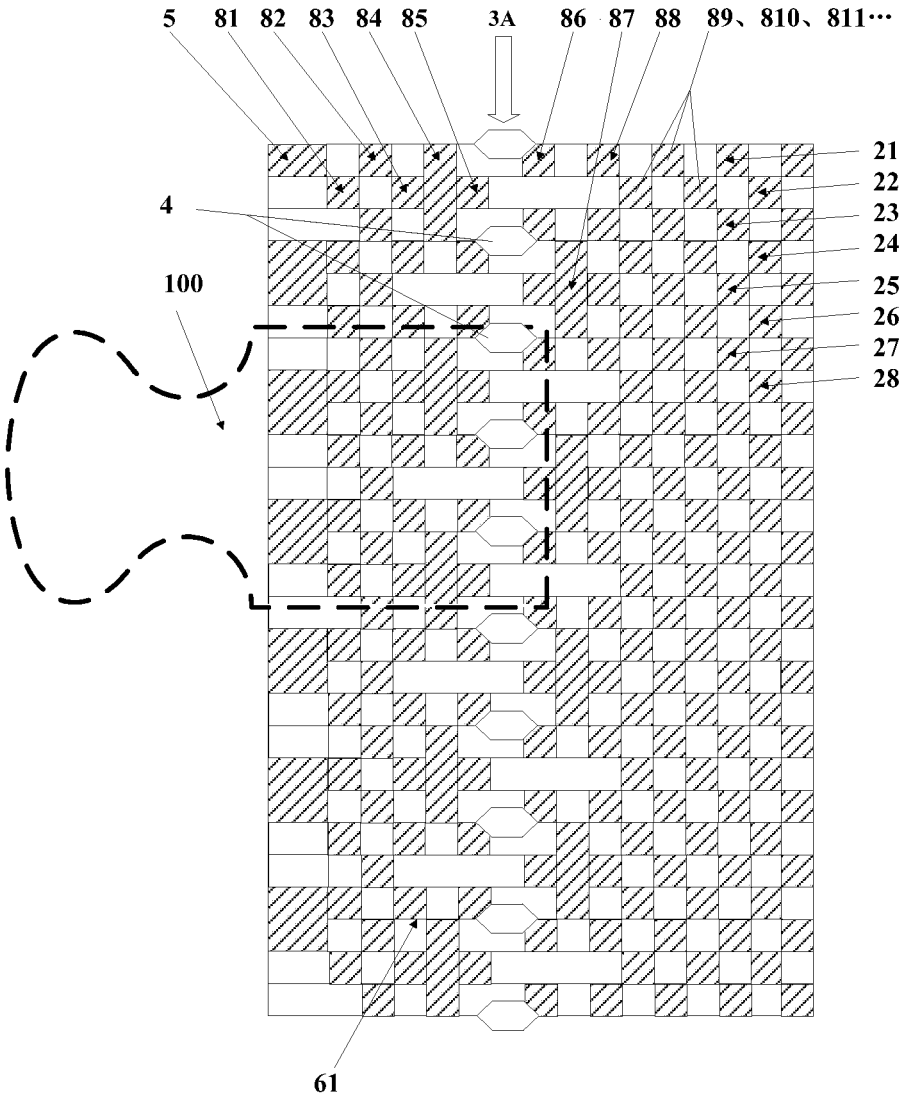
FIG. 14 is a partial diagram of the tape of FIG. 2 according to a fourth exemplary embodiment of the disclosure.
Figure 15:
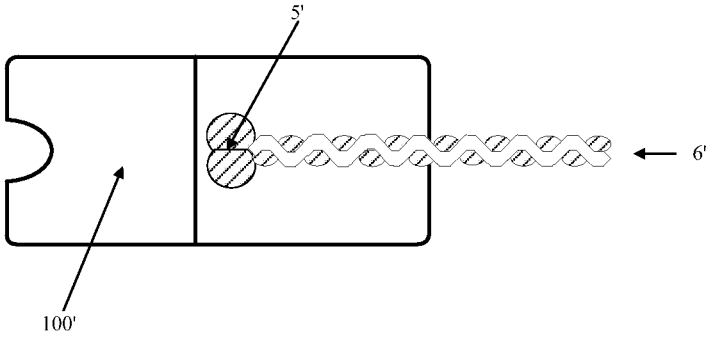
FIG. 15 is a cross sectional view of a prior derlin zipper.

FIG. 14 is a partially diagram of the tape 6 of the zipper 300 according to a fourth exemplary embodiment of the disclosure. In the embodiment, the bonding area 61 of the tape 6 defines an unoccupied position 3A without any warp yarn 8. Each of the positioning holes 4 extends to the unoccupied position 3A. In the process of weaving the tape 6, the unoccupied position 3A is defined between the warp yarn 85, 86. The configuration of the warp yarns 83, 84, 85, 86, 87, 88 are same as that of the warp yarns 83, 84, 85, 86, 87, 88 of the first exemplary embodiment. As a result, one row positioning holes 4 are defined between the warp yarns 85, 86, and evenly space from each other with three weft yarns 2, and are uniform in size.

Because there is the unoccupied position 3A defined between the warp yarns 85, 86, and each positioning hole 4 extends to the unoccupied position 3A, a size of the positioning hole 4 of the fourth exemplary embodiment is greater than that of the positioning hole 4 of the first exemplary embodiment. Accordingly, the diameter of the post 50 is getting thick, which ensures the tooth 100 to fix with the tape 6 firmly.

In the embodiments, the tape 6 is totally or partially made of polyester drawn yarn, which results smooth of an interior surface of the positioning hole 4. As a result, during a process of injection molding of the zipper 300, the liquid derlin material flows into the positioning hole 4 more smoothly, which ensures the formation of the post 50, and improves the bonding force between the tooth 100 and the tape 6.

Because one single tooth 100 generally covers at least five weft yarns 2, and one row positioning holes 4 evenly space from each other with three or four weft yarns 2, the portion of the bonding area 61 of the tape 6 corresponding to each tooth 100 covers at least one positioning hole 4. Therefore, during the process of injection molding the zipper 300 using the above tape 6, it is not required to worry about positioning between the tape 6 and the position for the tooth 100 of the injection mold. The process of injection molding the zipper 300 is simple and easy.

In particular, the weaving structure of the tape 6 of the zipper 300 is not limited to the above weaving structure of the four exemplary embodiments. Any zipper employing the tape 6 with a weaving structure by configuration of the structure of the warp yarns 8 on the bonding area 61 of the tape 6 to form the rows of the positioning holes 4 falls into the scope of the protection of the zipper 300 of the disclosure. Because of the positioning holes 4 of the tape 6, the post 50 forms in the tooth 100 to penetrate the tape 6 to fix the tooth 100 with the tape 6 firmly, during the process of injection molding of the zipper 300, which improves the bonding force between the tooth 100 and tape 6 obviously.

It follows that, the positioning holes 4 on the bonding area 61 of the tape 6 are formed by the structure configuration of the warp yarns 8, during the process of weaving the tape 6, without any special tools, any special process and any special material. In addition, the warp yarns 8 and the weft yarn 2 maintain integrity, without any damage after formation of the positioning holes 4, which ensures an unchanged appearance and an invariability intensity of the tape 6.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A zipper, comprising a pair of opposite tapes, each tape comprising a bonding area, and a plurality of teeth positioned on the bonding area along a length direction of the tape, each tooth defining a positioning groove, the bonding area of each tape jamming into the positioning grooves of the plurality of teeth to position the teeth on the tape; wherein a portion of the bonding area of each tape corresponding to one tooth defines at least one positioning hole, and each tooth comprises at least one post located in the positioning groove of the tooth, and the post passes through a corresponding positioning hole to fix the tooth on the tape, and wherein each tooth comprises a lower body and an upper body located upon the lower body, the positioning groove is located between the upper body and the lower body, and comprises a fixing groove and a inserting groove extending from the fixing groove and to an exterior surface of the tooth, and two ends of the post are respectively connected with the upper body and the lower body, and wherein each tape comprises a filler cord latched into the fixing groove, a group of warp yarns, and a group of continuously distributed weft yarns interwoven with the group of warp yarns, and wherein the bonding area of each tape inserts into the inserting grooves of the teeth, and wherein the post of each tooth is located at the inserting groove of the tooth and passes through a corresponding positioning hole in the bonding area of the tape.

2. The zipper of claim 1, wherein the upper body comprises a upper surface, a side surface and a first slant surface, the upper surface comprises a top surface and a second slant surface obliquely extending from the top surface and downwards the lower body, and wherein the second slant surface gradually shrinks to be a point, and the first slant surface connects between the upper surface and the side surface.

3. The zipper of claim 2, wherein the upper body comprises a head and a tail extending from the head, and the side surface comprises a pair of first sub surfaces, a pair of second sub surfaces, and a third sub surface, and wherein one end of one of the first sub surfaces intersects one end of another one of the first sub surfaces to collectively forms the head of the upper body, and the pair of second sub surfaces extend from other ends of the pair of first sub surfaces, respectively, and the third sub surface connects between the pair of second sub surfaces, and the pair of second sub surfaces and the third sub surface collectively forms the tail of the upper body.

4. The zipper of claim 3, wherein an included angle between the pair of first sub surfaces is larger than 30° and less than 45°.

5. The zipper of claim 3, wherein the first slant surface comprises a pair of first sub slant surfaces, a pair of second sub slant surfaces, and a third sub slant surface, one of the first sub slant surfaces connects between the second slant surface, one of the first sub surfaces, one of the second sub slant surfaces, and the top surface, and another one of the first sub slant surfaces connects between the second slant surface, another one of the first sub surfaces, another one of the second sub slant surfaces, and the top surface, and wherein one of the second sub slant surfaces connects between one of the second sub surfaces and the top surface, and another one of the second slant surface connects between another one of the second sub surfaces and the top surface, and wherein the third sub slant surface connects between the third sub surface and the top surface.

6. The zipper of claim 3, wherein a length of the tail is less than 65% of a length of the upper body.

7. The zipper of claim 3, wherein the tooth further comprises a projection partially surrounding one end of the tail away from the head, and a top of the projection is configured as a slant surface.

8. The zipper of claim 7, wherein a length of the positioning groove is greater than 50% of a length of the projection.

9. The zipper of claim 1, wherein the positioning holes in the bonding area of each tape are positioned continuously, and spaced from each other along an orientation of the teeth, and wherein the positioning holes are formed by structure configuration of the group of warp yarns, during a process of weaving the tape.

10. The zipper of claim 9, wherein the positioning holes in the bonding area are evenly spaced from each other, and three weft yarns are positioned between each two neighboring positioning holes.

11. The zipper of claim 10, wherein an unoccupied position without any warp yarn is defined on the bonding area of the tape, and each positioning hole extends to the unoccupied position.

12. The zipper of claim 9, wherein the positioning holes in the bonding area are evenly spaced from each other, and four weft yarns are positioned between each two neighboring positioning holes.

13. The zipper of claim 9, wherein the boding area of the tape defines two rows of positioning holes arranging continuously and evenly spacing from each other.

14. The zipper of claim 1, wherein the warp yarns are made of polyester drawn yarn.

* * * * *